US008196421B2

(12) United States Patent
Bush et al.

(10) Patent No.: US 8,196,421 B2
(45) Date of Patent: Jun. 12, 2012

(54) SYSTEM AND METHOD FOR CONTROLLED EXPANSION VALVE ADJUSTMENT

(75) Inventors: James W. Bush, Skaneateles, NY (US); Wayne P. Beagle, Chittenango, NY (US); Biswajit Mitra, Charlotte, NC (US)

(73) Assignee: Carrier Corporation, Farmington, CT (US)

( * ) Notice: Subject to any disclaimer, the term of this patent is extended or adjusted under 35 U.S.C. 154(b) by 812 days.

(21) Appl. No.: 12/308,015

(22) PCT Filed: Jun. 1, 2006

(86) PCT No.: PCT/US2006/021124

§ 371 (c)(1),
(2), (4) Date: Dec. 4, 2008

(87) PCT Pub. No.: WO2007/139554

PCT Pub. Date: Dec. 6, 2007

(65) Prior Publication Data

US 2009/0241566 A1 Oct. 1, 2009

(51) Int. Cl.
*F25B 41/04* (2006.01)

(52) U.S. Cl. ..... 62/224

(58) Field of Classification Search ..... 62/114, 62/222, 224, 225

See application file for complete search history.

(56) References Cited

U.S. PATENT DOCUMENTS

| | | | | |
|---|---|---|---|---|
| 4,197,719 | A | 4/1980 | Shaw | |
| 4,254,637 | A | 3/1981 | Brauch et al. | |
| 5,209,072 | A | 5/1993 | Truckenbrod et al. | |
| 5,353,602 | A | 10/1994 | Pincus | |
| 5,522,233 | A | 6/1996 | Nares et al. | |
| 5,890,370 | A | 4/1999 | Sakakibara et al. | |
| 6,105,378 | A | 8/2000 | Shaw | |
| 6,145,326 | A | 11/2000 | O'Brien | |
| 6,321,549 | B1 | 11/2001 | Reason et al. | |
| 6,418,735 | B1 | 7/2002 | Sienel | |
| 6,626,000 | B1 | 9/2003 | Meyer et al. | |
| 6,826,917 | B1 | 12/2004 | Bodell, II et al. | |
| 7,451,617 | B2 | 11/2008 | Renz et al. | |
| 2004/0020223 | A1 * | 2/2004 | Doi et al. | 62/225 |
| 2005/0150240 | A1 | 7/2005 | Doi | |
| 2005/0284164 | A1 * | 12/2005 | Ohta | 62/228.3 |
| 2006/0162377 | A1 * | 7/2006 | Collings | 62/527 |
| 2008/0104981 | A1 | 5/2008 | Heinbokel et al. | |

FOREIGN PATENT DOCUMENTS

| | | |
|---|---|---|
| EP | 0424474 B2 | 11/1997 |
| EP | 1369648 | 12/2003 |
| JP | 2001147048 A | 5/2001 |

OTHER PUBLICATIONS

Supplementary European Search Report and the European Opinion of the International Searching Authority, or the Declaration; PCT/US2006021124; Apr. 10, 2012.

* cited by examiner

*Primary Examiner* — Marc Norman

(74) *Attorney, Agent, or Firm* — Cantor Colburn LLP

(57) ABSTRACT

A method for controlling temperature pulldown of an enclosure with a refrigeration system having a compressor, a heat rejecting heat exchanger, an expansion valve, and an evaporator comprises circulating a refrigerant through the refrigeration system, sensing a parameter of the enclosure, determining a desired evaporator pressure based upon the parameter sensed, and adjusting the expansion valve as a function of the desired evaporator pressure.

19 Claims, 6 Drawing Sheets

SYSTEM AND METHOD FOR CONTROLLED EXPANSION VALVE ADJUSTMENT

BACKGROUND OF THE INVENTION

The present invention relates generally to refrigeration systems. More particularly, the present invention relates to transcritical refrigeration systems configured to improve temperature pulldown after system start-up.

In a typical refrigeration system that utilizes a circulating refrigerant, the refrigerant is circulated throughout a particular refrigerated area to remove heat from that area. The refrigerant enters the evaporator as a liquid or as a saturated mix of liquid and vapor and the liquid is evaporated (i.e., it boils off to pure vapor) as it absorbs heat from the refrigerated area. This process takes place at a refrigerant temperature somewhat below the temperature of the refrigerated area in order to facilitate heat transfer from the area to the refrigerant. The flow of refrigerant through the evaporator is normally regulated to maintain the temperature of the vapor exiting the evaporator at some fixed margin, or "superheat," above the saturated temperature of the liquid-vapor mix. This assures that exactly enough refrigerant is circulated to match the heat load of the refrigerated area. Because the refrigerated area may not require constant cooling, the refrigeration system may be turned off for a period of time, thereby allowing the refrigerated area and the refrigerant to warm to a temperature at or near the ambient temperature. When the refrigerated area once again requires cooling, the refrigeration system is turned on, and the refrigerant will initially go through the process of evaporation at a temperature somewhat below the ambient temperature. As the refrigerated area is cooled, the temperature of the evaporating refrigerant will drop accordingly until the refrigerated area reaches the desired temperature and the system stabilizes again. The process of cooling a refrigerated area from a warmer temperature following a system shutdown to a desired cooler setpoint temperature is known as "pulldown."

Refrigerants containing chlorine have been phased out in most of the world due to their ozone destroying potential. Hydrofluorocarbons (HFCs) have been used as replacement refrigerants, but these refrigerants also have high global warming potential. "Natural" refrigerants, such as carbon dioxide, have recently been proposed as replacement fluids. Unfortunately, there are problems with the use of these natural refrigerants as well. In particular, carbon dioxide has a low critical temperature, which causes the evaporator temperature and pressure to be above the critical point and in the supercritical region during start-up of the refrigeration system. When the refrigerant is at a temperature above the critical temperature, there are no separate liquid and vapor phases and so the normal process of evaporation cannot take place. When the evaporator temperature is supercritical there is no such thing as "superheat," and therefore, the flow regulating device is unable to operate properly. As a result, it becomes very difficult to control the initial pulldown process that is necessary to bring the refrigerated area to the desired setpoint temperature and to return the refrigerant to a normal subcritical process.

Thus, there exists a need for a refrigeration system with improved pulldown control when a transcritical refrigerant, such as carbon dioxide, is used in a transcritical mode to provide cooling.

BRIEF SUMMARY OF THE INVENTION

The present invention is a system and method for controlling temperature pulldown of a refrigerated enclosure with a refrigeration system having a compressor, a heat rejecting heat exchanger, an expansion valve, and an evaporator. The method comprises circulating a refrigerant through the refrigeration system, sensing a parameter of the enclosure, determining a desired evaporator pressure based upon the parameter sensed, and adjusting the expansion valve as a function of the desired evaporator pressure.

DETAILED DESCRIPTION

Figure 1:
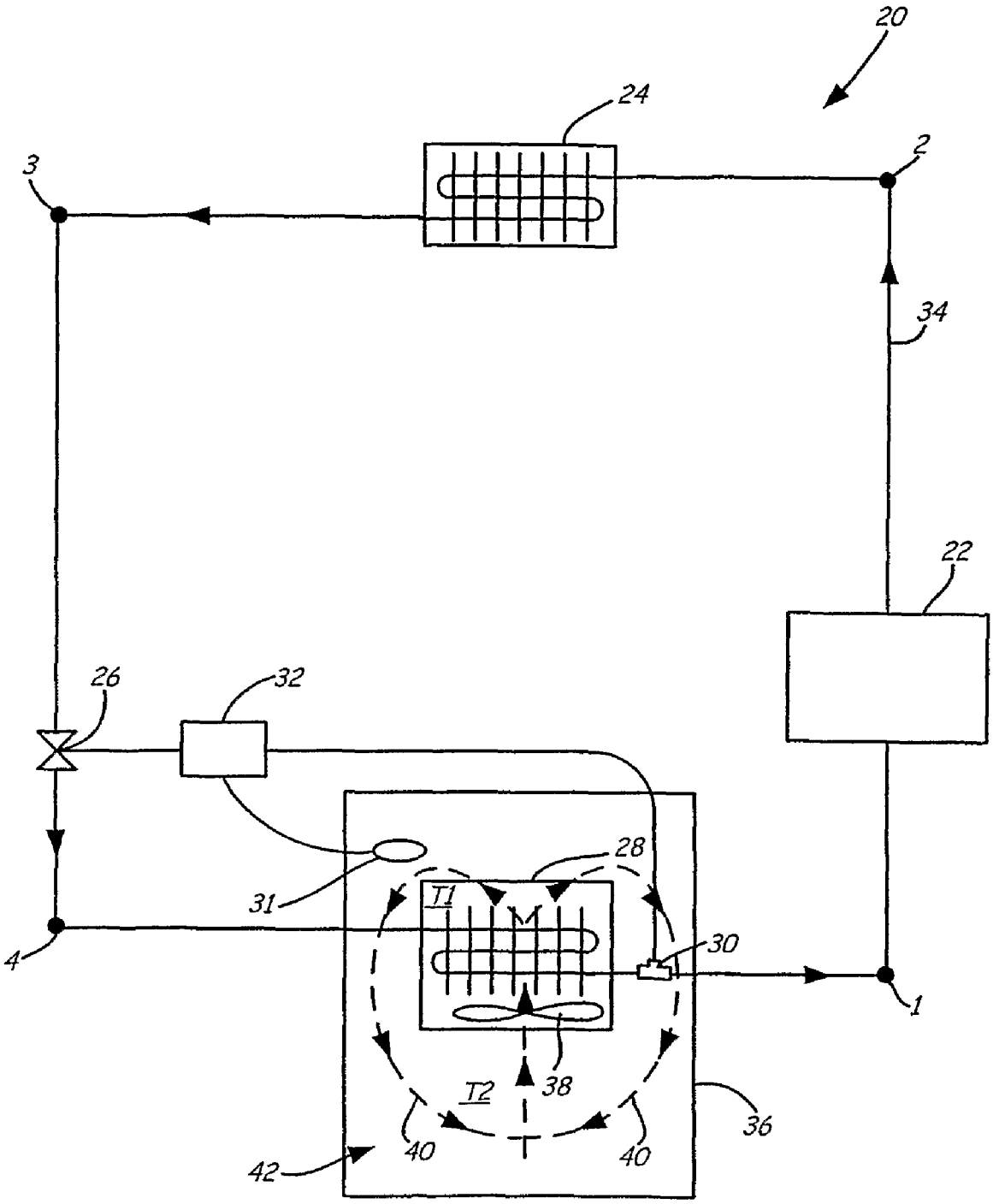
FIG. 1 illustrates one embodiment of a refrigeration system according to the present invention.

FIG. 1 illustrates a schematic diagram of refrigeration system 20, which includes compressor 22, gas cooler 24, expansion valve 26, evaporator 28, evaporator sensor 30, enclosure sensor 31, and valve controller 32. Compressor 22 may comprise any type of compressor including, but not limited to, reciprocating, scroll, screw, rotary vane, standing vane, variable speed, hermetically sealed, and open drive compressors.

Refrigeration system 20 is useful wherever a cooling source is needed, such as in temperature control units for buildings and automobiles. However, refrigeration system 20 will be described generically in reference to an "enclosure" that requires cooling. For example, the "enclosure" may be an office area in a building or the food storage area in a refrigerated-type food transport vehicle.

As shown in FIG. 1, refrigerant path 34 is formed by connection of the various elements in refrigeration system 20. Refrigerant path 34 is created by a loop defined by the points 1, 2, 3, and 4. After start-up of refrigeration system 20 from a non-operational mode to an operational, cooling mode, refrigerant is first compressed within compressor 22. The refrigerant then exits compressor 22 at high pressure and enthalpy (point 2) and is directed through gas cooler 24. The refrigerant loses heat in gas cooler 24, and exits gas cooler 24 at low enthalpy and high pressure (point 3). Next, the refrigerant exiting gas cooler 24 is throttled in expansion valve 26. Expansion valve 26 is preferably an electronic expansion valve (EXV). After going through an expansion process within expansion valve 26 (point 4), the refrigerant is directed toward evaporator 28. After being heated in evaporator 28 (point 1), the refrigerant once again enters compressor 22, and the cycle repeats.

As shown in FIG. 1, evaporator 28 of refrigeration system 20 is disposed within enclosure 36, which represents an area that requires cooling. A circulation element 38, such as a fan or blower, is coupled to enclosure 36 and is configured to direct streams of air 40 past evaporator 28 in an attempt to cool interior 42 of enclosure 36.

During initial start-up of refrigeration system 20, temperature T1 of evaporator 28 will be approximately equal to temperature T2 of enclosure 36. In particular, if refrigeration system 20 has been in the non-operational mode for an extended period of time, it is likely that temperatures T1 and T2 are substantially equivalent to the ambient air temperature outside enclosure 36. When using standard, HFC refrigerants, the fact that temperature T1 of evaporator 28 may be equal to the ambient temperature is not much of a concern because HFC refrigerants typically have high critical temperatures. As a result, refrigeration systems using HFC refrigerants tend to run "subcritical." System operation and cooling capacity are relatively easy to control in a subcritical system due to the defined relationship between pressure and temperature in the subcritical region.

On the other hand, when using transcritical refrigerants such as carbon dioxide, the fact that temperature T1 of evaporator 28 may be equal or close to the ambient temperature is problematic because carbon dioxide has a relatively low critical temperature. The critical temperature of carbon dioxide is about 87.8 degrees Fahrenheit. In warm climates, it is common for the ambient air temperature to exceed the critical temperature of carbon dioxide. When this occurs, temperatures T1 and T2 may exceed the critical temperature, thus resulting in a "supercritical" evaporator temperature. As will be discussed in more detail to follow, in order to achieve effective heat transfer between evaporator 28 and enclosure 36 in such an environment, temperature T1 of evaporator 28 must be decreased to a subcritical temperature, i.e., a temperature that is below the critical temperature of the refrigerant. If temperature T1 remains supercritical during operation of refrigeration system 20, the system will have minimal cooling capacity and, as a result, it will be difficult or impossible to pull down the temperature of enclosure 36 much below the ambient temperature. This is especially detrimental when refrigeration system 20 is used in, for example, a refrigeration-type truck carrying perishable goods within enclosure 36. In that embodiment, it is critical that refrigeration system 20 is capable of pulling down temperature T2 of enclosure 36 to a low temperature within a short amount of time so that the perishable goods do not spoil. However, without having the capability to pull down temperature T1 of evaporator 28 into the subcritical region, refrigeration system 20 is almost useless as a cooling source. The present invention provides a system and method for operating a refrigeration system to pull down an enclosure temperature while operating in either a subcritical or a supercritical cycle.

In refrigeration system 20, expansion valve 26, evaporator sensor 30, enclosure sensor 31, and valve controller 32 operate together to enable sufficient enclosure temperature pulldown such that refrigeration system 20 remains useful as a cooling source even when operating in an environment wherein the ambient temperature is above the critical temperature of the refrigerant. Evaporator sensor 30 of refrigeration system 20 is coupled to evaporator 28, and is configured to sense a parameter within evaporator 28 and send a signal corresponding to the parameter to valve controller 32. Preferably, the parameter sensed by evaporator sensor 30 is evaporator pressure, although other parameters (such as temperature) that may be sensed and used to deduce pressure are also contemplated. Similarly, enclosure sensor 31 of refrigeration system 20 is coupled to enclosure 36, and is configured to sense a parameter within enclosure 36, such as temperature, and send a signal corresponding to the parameter to valve controller 32. Valve controller 32 may use a combination of, for example, the evaporator pressure, enclosure temperature, and the desired enclosure temperature setpoint to determine a desired evaporator pressure that will reduce the evaporator temperature to a subcritical temperature and enable pulldown of the enclosure temperature to the desired temperature setpoint.

In one embodiment of the present invention, enclosure sensor 31 includes a temperature transducer such as a thermocouple, RTD (resistance temperature detector), or thermistor. Enclosure sensor 31 is configured to sense the temperature within interior 42 of enclosure 36 and send a signal to valve controller 32. Based upon the enclosure temperature, valve controller 32 determines the proper adjustment to the evaporator pressure necessary in order to attain the requisite heat transfer between evaporator 28 and enclosure 36 and achieve the desired enclosure setpoint temperature.

Furthermore, in one embodiment, expansion valve 26 is an electronic expansion valve (EXV) and evaporator sensor 30 includes a pressure transducer embedded in an evaporator tube to measure the refrigerant pressure. The pressure transducer provides a feedback signal to valve controller 32 which accordingly controls the movement of expansion valve 26. The EXV includes is a mechanical valve coupled to a stepper motor to control the opening and closing of the valve orifice. The stepper motor responds to the valve controller input by opening or closing the valve orifice as necessary. Typically, the pressure drop is modified by controlling the size of an orifice or flow restriction disposed within expansion valve 26.

For normal steady-state operation where the evaporator is in a subcritical state, evaporator sensor 30 may additionally include a temperature transducer in order to determine superheat of the refrigerant vapor exiting evaporator 28 by comparing the temperature of the vapor to the saturated pressure within evaporator 28.

Figure 2:
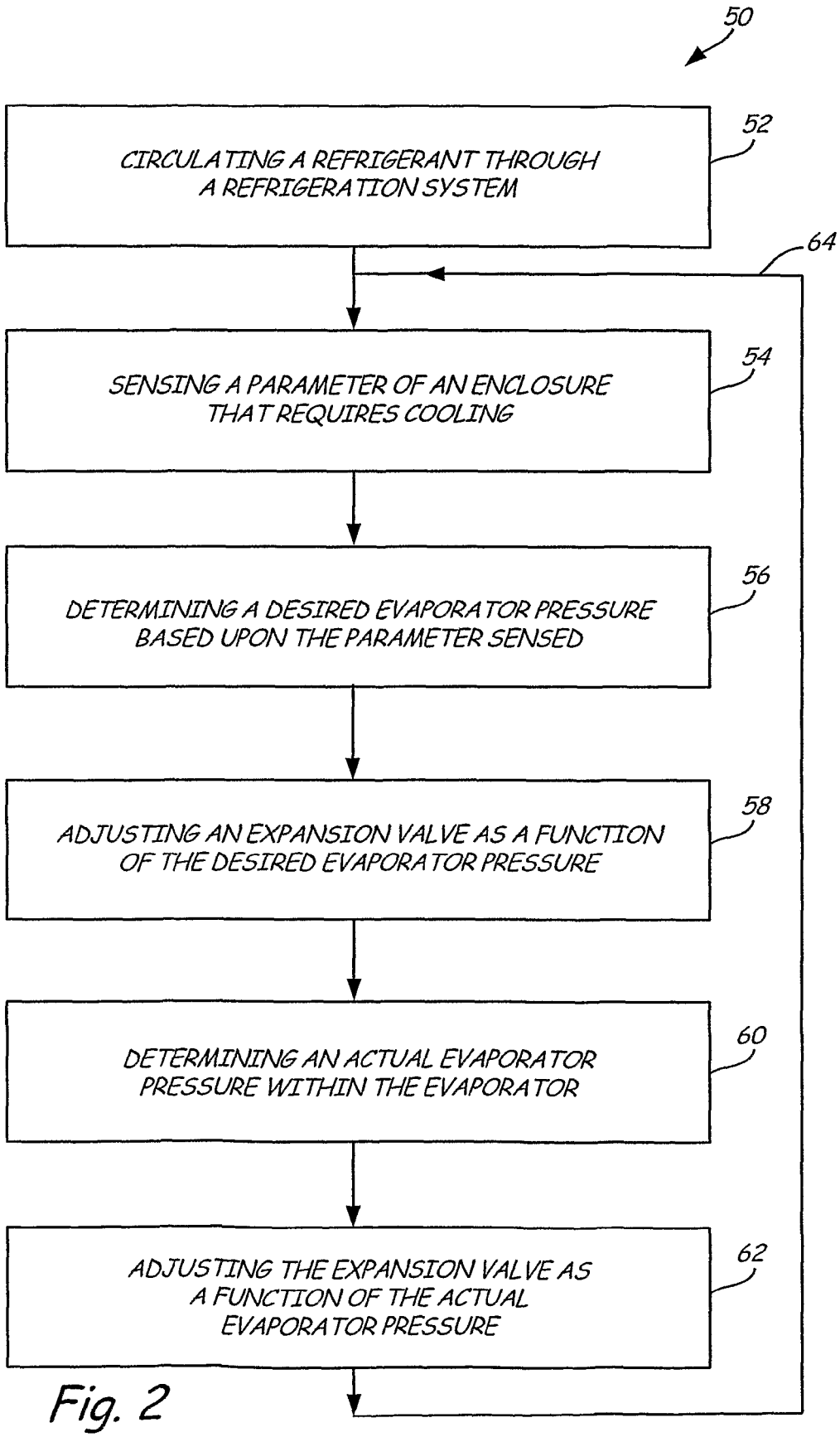
FIG. 2 is a process flow diagram illustrating the steps executed in performing a temperature pulldown method according to the present invention.

FIG. 2 is a process flow diagram of a method 50 for controlling temperature pulldown of an enclosure with a refrigeration system. For purposes of example, method 50 will be discussed in reference to refrigeration system 20 of FIG. 1.

Method 50 begins at step 52 by circulating a refrigerant through a refrigeration system, such as refrigeration system 20. Method 50 continues at step 54 by sensing a parameter of an enclosure that requires cooling. In one embodiment of the present invention, the sensed parameter is the temperature of enclosure 36. Next, in step 56, a desired evaporator pressure is determined based upon the sensed parameter within the enclosure. Any parameter or combination of parameters that enables refrigeration system 20 to determine the desired evaporator pressure is within the intended scope of the present invention. Then, in step 58, the expansion valve is adjusted as a function of the desired evaporator pressure. In one embodiment, expansion valve 26 is adjusted to lower the evaporator pressure from a supercritical pressure to a subcritical pressure. After adjusting the expansion valve in step 58, an actual evaporator pressure is determined in step 60, such as with evaporator sensor 30. Finally, in step 62, the expansion valve is adjusted as a function of the actual evaporator pressure determined in step 60. It is important to note than in some instances, it may be necessary to perform steps 54-62 continuously or at defined intervals, as indicated by arrow 64, in order to achieve or maintain the desired enclosure setpoint temperature.

In some instances, the various steps comprising method 50 may be performed in a slightly different order. Furthermore, one or more of the steps may be omitted without departing from the intended scope of the present invention. For example, steps 60 and 62 may be omitted such that method 50 adjusts the expansion valve based solely on sensing the enclosure parameter and not on the actual evaporator pressure as well.

By performing method 50, it is possible to pull down the enclosure temperature in a refrigeration system that utilizes any type of refrigerant, operating in either subcritical or transcritical cycles. However, method 50 is particularly useful in conjunction with refrigeration systems configured to operate in a transcritical mode. As discussed previously, these types of systems typically run supercritical when used in a hot ambient temperature. The system and method of the present invention enables pulldown of the enclosure temperature even in hot ambient conditions. Thus, the present invention allows a refrigeration system to maintain the evaporator in a subcritical state even when operating in an environment above the critical temperature of the refrigerant being used.

Figure 3:
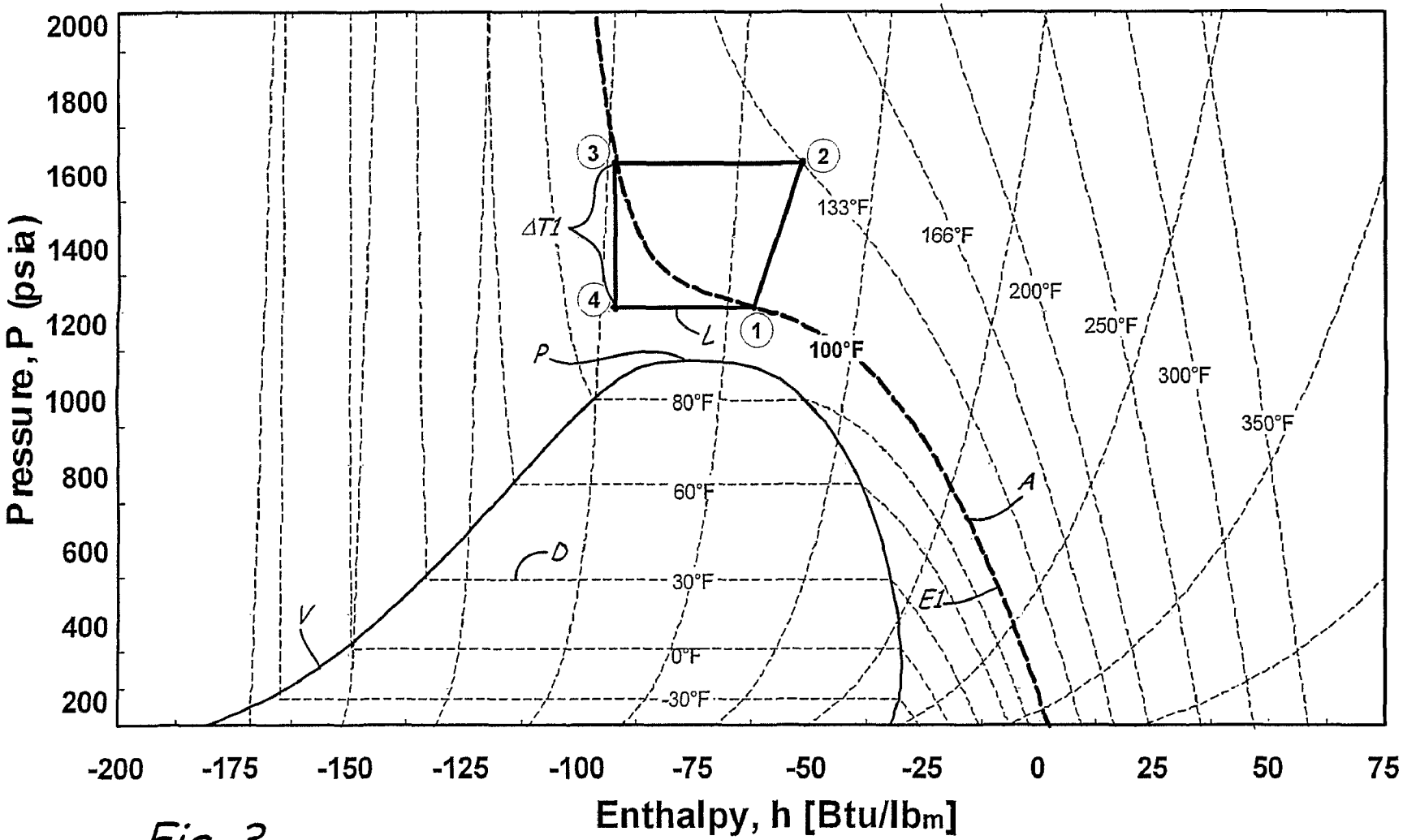
FIG. 3 illustrates a graph relating pressure to enthalpy for the refrigeration system of FIG. 1 after system start-up and prior to application of the temperature pulldown method.

FIG. 3 illustrates a graph relating pressure to enthalpy after start-up of refrigeration system 20 and prior to application of temperature pulldown method 50. As shown in FIG. 3, refrigeration system 20 is configured to circulate carbon dioxide. However, it should be understood that carbon dioxide is used merely for purposes of example and not for limitation. Furthermore, the cycle in FIG. 3 assumes that the heat exchangers in refrigeration system 20 are ideal and that the pressure within evaporator 28 is held substantially constant.

In FIG. 3, vapor dome V is formed by a saturated liquid line and a saturated vapor line, and defines the state of the refrigerant at various points along the refrigeration cycle. Underneath vapor dome V, all states involve both liquid and vapor coexisting at the same time. At the very top of vapor dome V is critical point P. The critical point P is defined by the highest temperature and pressure where saturated liquid and saturated vapor coexist. In general, compressed liquids are located to the left of vapor dome V, while superheated vapors are located to the right of vapor dome V. As critical point P is approached, the properties of both liquid and gas become the same. Thus, above the critical point, there is only one phase. In particular, above its critical pressure, a substance cannot be separated into liquid and vapor phases.

As shown in FIG. 3, within vapor dome V the temperature of the refrigerant remains constant at a specified pressure. Thus, the pressure and temperature of a refrigerant in the subcritical region are directly related. However, outside of vapor dome V, there is no specific relationship between temperature and pressure. For example, the pressure within evaporator 28 (between points 4 and 1) remains around 1200 psia, but the temperature within evaporator 28 increases from about 85 degrees Fahrenheit (point 4) at the inlet of evaporator 28 to about 100 degrees Fahrenheit at the outlet (point 1). Therefore, outside of the subcritical region of vapor dome V, the relationship between temperature and pressure disappears.

In FIG. 3, refrigerant path 34 is the loop defined by the points 1, 2, 3, and 4. The cycle begins in the main path at point 1, where the refrigerant is a low pressure, high enthalpy supercritical fluid prior to entering compressor 22. After compression within compressor 22, the refrigerant exits compressor 22 at high pressure and enthalpy, as shown by point 2. Then, as the refrigerant flows through gas cooler 24, enthalpy decreases while pressure remains constant, and the refrigerant exits as a cooler supercritical fluid. After exiting gas cooler 24, the refrigerant is then throttled in expansion valve 26, decreasing pressure as shown by point 4. Finally, the refrigerant is directed through evaporator 28, where it exits as a higher enthalpy supercritical fluid as shown by point 1. As shown in FIG. 3, points 1, 2, 3, and 4 of the refrigeration cycle reside above the critical point P. When every point of a refrigeration cycle is located above the critical point for the refrigerant, the cycle is known as a "supercritical" cycle. In this supercritical region, the liquid and gas phases are no longer clearly distinguishable from each other, and the refrigerant remains a supercritical fluid throughout the entire cycle.

In a refrigeration system, the specific cooling capacity, which is the measure of total cooling capacity divided by refrigerant mass flow, may typically be represented on a graph relating pressure to enthalpy by the length of the evaporation line. As shown in FIG. 3, the specific cooling capacity of refrigeration system 20 after start-up is represented by the length of evaporation line L from point 4 to point 1. The specific cooling capacity determines the amount of heat transfer possible between a refrigeration system and an area to be cooled. In particular, the location of point 1 along evaporation line L is directly related to the temperature at point 1 which in turn is generally proportional to the temperature of the area to be cooled. Note that with an increase in pressure, the constant temperature lines near point 1 curve towards the left. Therefore, for a given enclosure temperature, with an increase in pressure, the maximum possible specific capacity decreases as point 1 slides left along the constant enclosure temperature isotherm. Also, for a given enclosure temperature, an increase in pressure causes the evaporator temperature to increase, thereby decreasing the available temperature differential between the enclosure and the evaporator, and decreasing the heat transfer between the refrigerant and the enclosure. As a result, there is an adverse effect on the specific capacity.

In FIG. 3, both the enclosure temperature E1 of enclosure 36 and the ambient temperature A of the air outside enclosure 36 are about 100 degrees Fahrenheit. Furthermore, in this example, the desired temperature setpoint D of enclosure 36 is approximately 30 degrees Fahrenheit. Thus, in order to cool enclosure 36 to desired setpoint D, refrigeration system 20 must have sufficient cooling capacity. In particular, what drives the heat exchange between evaporator 28 and enclosure 36 is the temperature difference $\Delta T1$ between evaporator 28 and enclosure 36. As shown in FIG. 3, temperature difference $\Delta T1$ is about 15 degrees Fahrenheit at point 4 and decreases rapidly to about 0 degrees Fahrenheit at point 1. Due to the small temperature difference, the cooling capacity of the system is also small. Therefore, it is very difficult to pull down the temperature within enclosure 36 to desired temperature setpoint D (especially in a short period of time) without adjusting expansion valve 26, such as by method 50 as discussed above.

Figure 4:
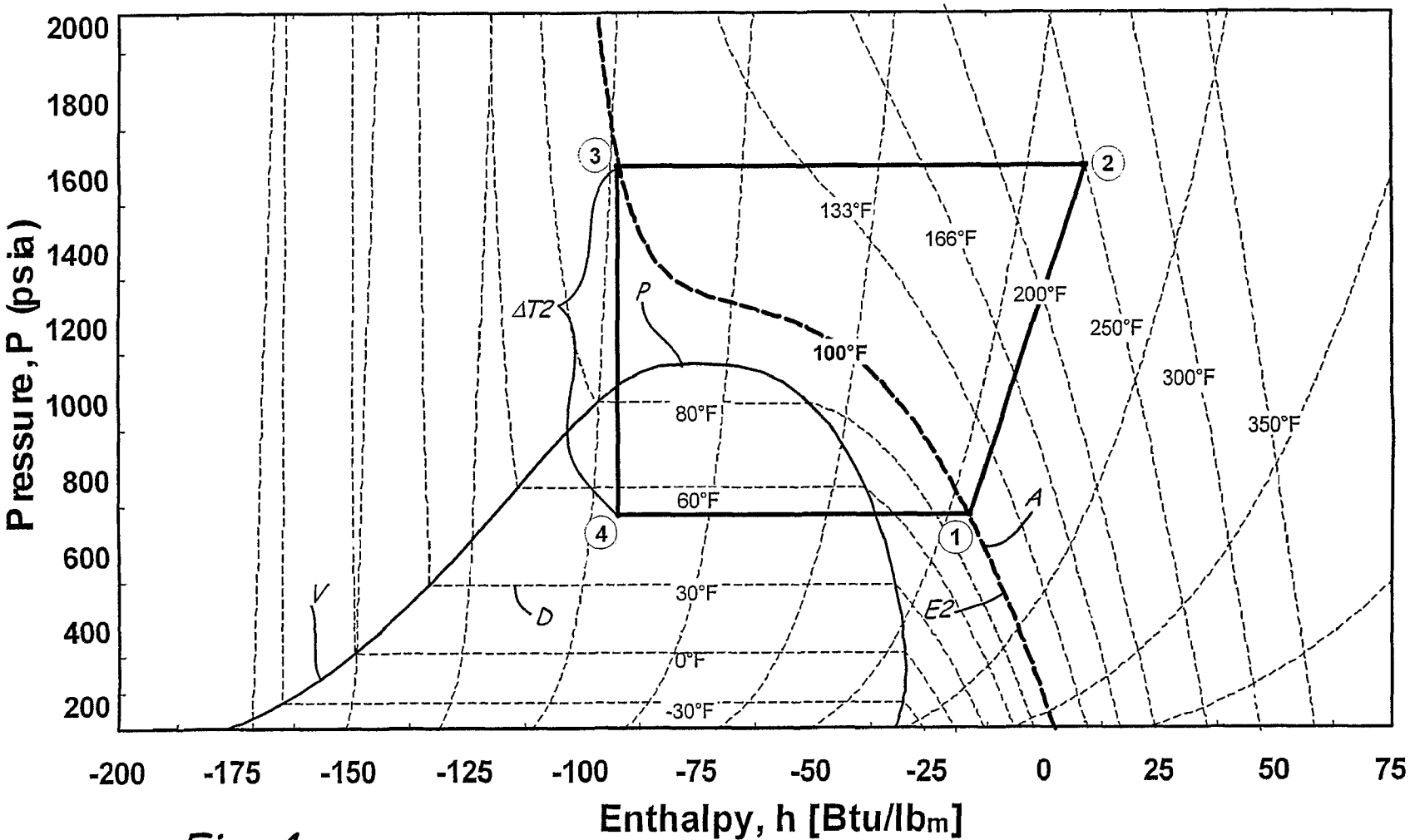
FIG. 4 illustrates a graph relating pressure to enthalpy after start-up and a first application of the temperature pulldown method.

FIG. 4 illustrates a graph relating pressure to enthalpy after start-up and a first application of temperature pulldown method 50. As shown in FIG. 4, the adjustment of expansion valve 26 has caused the pressure of evaporator 28 to drop below vapor dome V and into the two-phase subcritical region of the vapor dome. In particular, the evaporator pressure has dropped from about 1200 psia to about 700 psia, while the gas cooler pressure has remained constant at about 1600 psia. After the first application of method 50, points 2 and 3 of the refrigeration cycle remain above vapor dome V, while points 1 and 4 now reside below vapor dome V. Whenever the gas cooler pressure is above the vapor dome and the evaporator pressure is below the vapor dome, the refrigeration cycle is known as a "transcritical" cycle.

Inside of vapor dome V, the evaporator temperature remains constant. As a result, at a constant pressure, temperature difference $\Delta T2$ also remains constant within this region. Therefore, unlike temperature difference $\Delta T1$ of FIG. 3 which continuously varied even at a constant pressure, temperature difference $\Delta T2$ is both known and constant at all times within vapor dome V. In particular, within vapor dome V, temperature and pressure are directly related. Therefore, in this subcritical region, the temperature of the refrigerant determines the pressure, and vice versa. This fixed relationship allows precise control of both evaporator temperature and pressure. Thus, a particular evaporator temperature may be achieved by adjusting expansion valve 26 to the evaporator pressure that corresponds with that temperature. In particular, method 50 allows refrigeration system 20 to constantly monitor and control the temperature difference between evaporator 28 and enclosure 36, and in turn, the cooling capacity of the system.

As stated above, adjusting the pressure drop caused by expansion valve 26 such that the evaporator pressure is now within the subcritical region results in an increased refrigeration capacity. This increased capacity is represented by the length of the evaporation line from point 4 to point 1. The main factor contributing to the increased refrigeration capacity is the large increase in the enthalpy at the evaporator exit temperature. As shown in FIG. 4, the evaporator capacity has increased over the supercritical cycle of FIG. 3 even though the evaporator outlet temperature has remained the same. In addition, not only has the refrigeration capacity increased, but the ability to control the capacity has also improved by the transition from a supercritical cycle where there is no defined relationship between temperature and pressure to a transcritical cycle where the relationship between temperature and pressure is known.

It should be noted that decreasing the evaporator pressure further for a given enclosure temperature may not necessarily increase the capacity further since the lower pressure also decreases the density of the vapor returning to compressor 22 at point 1, and thus decreases the total mass flow of the circulating refrigerant. The optimal pressure in evaporator 28 will be a tradeoff between the increased specific capacity, as seen by comparing the pressure-enthalpy diagrams of FIGS. 3 and 4, and the lower total mass flow resulting from the lower vapor density at point 1. Therefore, valve controller 32 must be programmed to determine the optimal pressure in evaporator 28 for a given enclosure temperature in order to maximize the net cooling capacity of the resulting refrigerant flow.

As shown in FIG. 4, enclosure temperature E2 is still substantially equivalent to ambient air temperature A after a first application of method 50. This results from the fact that the evaporator pressure has just dropped down into the subcritical region, and there has not been a sufficient amount of time for heat to transfer from enclosure 36 to the refrigerant flowing through evaporator 28. However, as will be seen in the following figures, the system and method of the present invention will result in a decrease in the enclosure temperature to the desired temperature setpoint D over time.

Figure 5:
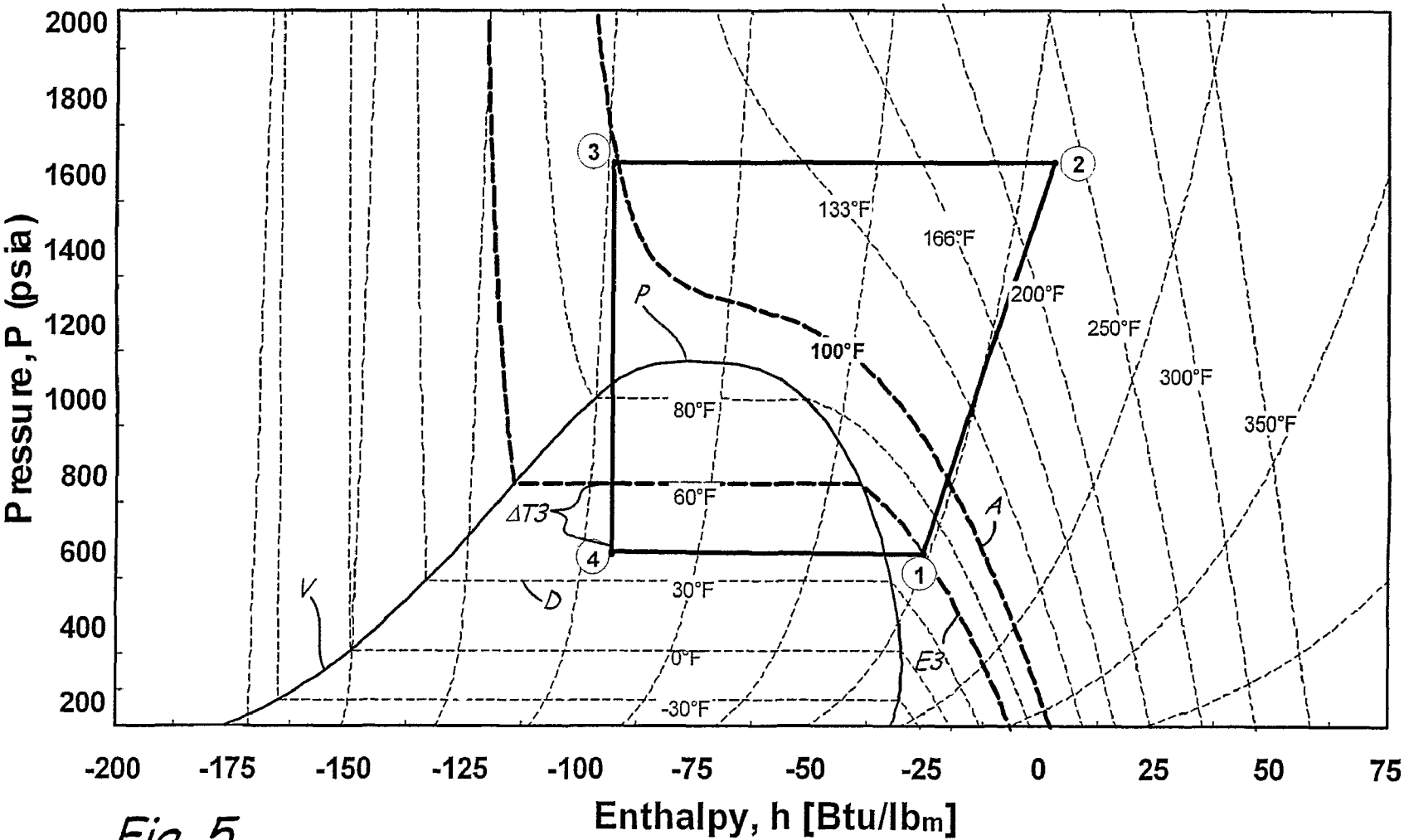
FIG. 5 illustrates a graph relating pressure to enthalpy after start-up and a second application of the temperature pulldown method.

FIG. 5 illustrates a graph relating pressure to enthalpy after a second application of temperature pulldown method 50. As shown in FIG. 5, the controlled adjustment of expansion valve 26 has caused the pressure of evaporator 28 to drop to a lower pressure within vapor dome V. In particular, the evaporator pressure has dropped to about 550 psia, while the gas cooler pressure has remained constant at about 1600 psia. After the second application of method 50, the refrigeration cycle is still operating as a transcritical cycle. However, the pressure difference between the high side gas cooler pressure and the low side evaporator pressure has increased.

As shown in FIG. 5, enclosure temperature E3 has dropped from about 100 degrees Fahrenheit to about 60 degrees Fahrenheit. This decrease in enclosure temperature is a direct result of the controlled adjustment of expansion valve 26 according to temperature pulldown method 50. Without adjusting expansion valve 26 to decrease the evaporator pressure into a region of two-phase flow, it would not have been possible to achieve the decrease in the enclosure temperature under the present conditions.

By performing temperature pulldown method 50, refrigeration system 20 has been able to pull down enclosure temperature E3 closer toward desired temperature setpoint D, which is about 30 degrees Fahrenheit. However, since desired temperature setpoint D of enclosure 36 is lower than enclosure temperature E3 as shown in FIG. 5, it may be necessary to decrease the evaporator pressure even further to lower the evaporator temperature to enable sufficient heat transfer. This may be accomplished by once again performing temperature pulldown method 50, as will be represented graphically in FIG. 6.

It is important to note that from a control point of view, when the enclosure temperature is reasonably below the critical temperature of the refrigerant, it may no longer be necessary to monitor the enclosure temperature and evaporator temperature. A metering of refrigerant based on the evaporator superheat may be sufficient to control the system operation.

Figure 6:
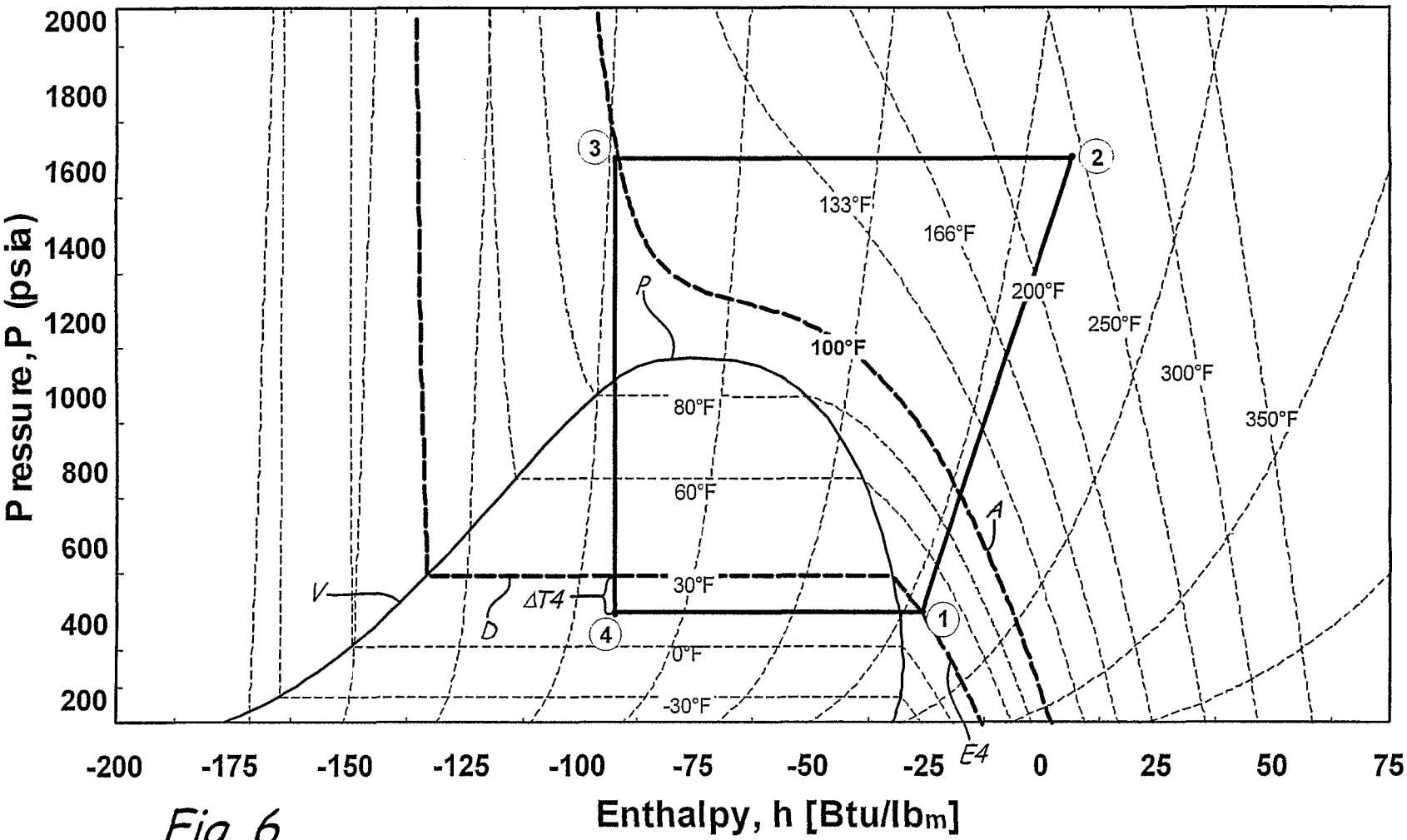
FIG. 6 illustrates a graph relating pressure to enthalpy after start-up and during steady-state operation after pulldown.

FIG. 6 illustrates a graph relating pressure to enthalpy for the final, steady state operation of the system where enclosure temperature E4 is substantially equivalent to desired temperature setpoint D after application of pulldown method 50 over a reasonably short period of time. In particular, the temperature of enclosure 36 has been pulled down from ambient temperature A in FIG. 3 to desired temperature setpoint D in FIG. 6 through controlled adjustment of expansion valve 26. When an enclosure temperature reaches and maintains a desired setpoint temperature, the refrigeration system is said to be in steady state operation. At steady state operation, it is no longer necessary to control expansion valve 26 as described previously in order to maintain enclosure temperature E4 at desired temperature setpoint D. At steady state, refrigeration system 20 may continue to operate by application of a method similar to method 50 described above. However, refrigeration system 20 may alternatively use any number of other devices and methods to control the evaporator temperature during steady state operation of refrigeration system 20. For example, refrigeration system 20 may include an additional sensor disposed near the outlet of evaporator 28 that is configured to sense the temperature of the refrigerant flowing through the outlet and control temperature of the refrigerant within the evaporator based upon this sensed value.

Although the present invention has been described in reference to three applications of method 50 prior to reaching steady state operation, embodiments that require more or less applications of method 50 are within the intended scope of the present invention. In particular, the number of applications required depends on many factors, including the desired efficiency, the desired time to pull down to the setpoint temperature, and the desired size of the evaporator pressure changes to maintain effective performance during pulldown. Therefore, the present invention has been described in reference to three applications of temperature pulldown method 50 for purposes of example and not for limitation.

In addition, it should be understood that carbon dioxide was used as the refrigerant for purposes of example only. The system and method of the present invention may be used with any other type of refrigerant without departing from the intended scope of the present invention.

Although the present invention has been described with reference to preferred embodiments, workers skilled in the art will recognize that changes may be made in form and detail without departing from the spirit and scope of the invention.

The invention claimed is:

1. A method for controlling temperature pulldown of an enclosure with a refrigeration system having a compressor, a heat rejecting heat exchanger, an expansion valve, and an evaporator, the method comprising:

circulating a refrigerant through the refrigeration system;

sensing a parameter of the enclosure; determining a desired evaporator pressure based upon the parameter sensed; and adjusting the expansion valve as a function of the desired evaporator pressure;

wherein the step of adjusting the expansion valve as a function of the desired evaporator pressure decreases an actual evaporator pressure from a supercritical pressure to a subcritical pressure.

2. The method of claim 1, wherein the parameter of the enclosure is temperature.

3. The method of claim 1, and further comprising: determining an actual evaporator pressure within the evaporator; and adjusting the expansion valve as a function of the actual evaporator pressure.

4. The method of claim 1, wherein the refrigerant operates in a transcritical refrigeration cycle.

5. The method of claim 1, wherein the refrigerant is carbon dioxide.

6. The method of claim 1, wherein the expansion valve is an electronic expansion valve.

7. A refrigeration system for cooling an enclosure comprising:

a compressor for compressing a refrigerant to a gas cooler pressure, wherein the gas cooler pressure is a supercritical pressure;

a gas cooler for cooling the refrigerant;

an evaporator for heating the refrigerant, wherein the evaporator has an evaporator pressure;

an expansion valve disposed between the gas cooler and the evaporator and configured to reduce the pressure of the refrigerant from the supercritical gas cooler pressure to a desired evaporator pressure, wherein the desired evaporator pressure is a subcritical pressure, the expansion valve decreasing an actual evaporator pressure from a supercritical pressure to the subcritical pressure; and a sensor for monitoring an enclosure parameter.

8. The refrigeration system of claim 7, wherein the refrigerant is carbon dioxide.

9. The refrigeration system of claim 7, wherein the refrigerant operates in a transcritical refrigeration cycle.

10. The refrigeration system of claim 7, wherein the enclosure parameter is enclosure temperature.

11. The refrigeration system of claim 7, wherein the sensor is configured to send a signal to a valve controller indicative of the enclosure parameter.

12. The refrigeration system of claim 11, wherein the valve controller is configured to adjust the evaporator pressure based upon the enclosure parameter.

13. The refrigeration system of claim 7, wherein the expansion valve is an electronic expansion valve.

14. A method for operating a refrigeration system having a compressor, a heat rejecting heat exchanger, an expansion valve, and an evaporator, the method comprising:

circulating a refrigerant through the refrigeration system; and adjusting an orifice of the expansion valve as a function of a sensed parameter to decrease an actual evaporator pressure from a supercritical pressure to a subcritical pressure.

15. The method of claim 14, wherein the sensed parameter is temperature.

16. The method of claim 14, wherein the sensed parameter is pressure.

17. The method of claim 16, wherein the step of adjusting the orifice of the expansion valve comprises sensing the evaporator pressure and comparing the evaporator pressure to a desired pressure.

18. The method of claim 14, wherein the refrigerant operates in a transcritical refrigeration cycle.

19. The method of claim 14, wherein a valve controller receives the sensed parameter and is configured to adjust the orifice of the expansion valve based on the sensed parameter.

* * * * *